US008951097B2

(12) United States Patent
Gacoin

(10) Patent No.: US 8,951,097 B2
(45) Date of Patent: Feb. 10, 2015

(54) METHOD FOR MOUNTING AN OPTICAL LENS TO BE POLISHED

(75) Inventor: Eric Gacoin, Charenton Le Pont (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 235 days.

(21) Appl. No.: 13/519,117

(22) PCT Filed: Dec. 22, 2010

(86) PCT No.: PCT/EP2010/070598
§ 371 (c)(1),
(2), (4) Date: Jun. 25, 2012

(87) PCT Pub. No.: WO2011/076904
PCT Pub. Date: Jun. 30, 2011

(65) Prior Publication Data

US 2012/0295518 A1 Nov. 22, 2012

(30) Foreign Application Priority Data

Dec. 24, 2009 (EP) ..... 09306328

(51) Int. Cl.
*B24B 13/005* (2006.01)
*B24B 9/14* (2006.01)
*B24B 41/06* (2012.01)

(52) U.S. Cl.
CPC ..... *B24B 13/005* (2013.01); *B24B 9/146* (2013.01); *B24B 41/061* (2013.01)
USPC ..... 451/42; 451/384; 451/390; 451/364

(58) Field of Classification Search
CPC ..... B24B 13/005; B24B 13/0052; B24B 13/0055; B24B 9/161
USPC ..... 451/42, 384, 390, 364, 460
See application file for complete search history.

(56) References Cited

U.S. PATENT DOCUMENTS

| | | | | | |
|---|---|---|---|---|---|
| 2,520,977 | A | * | 9/1950 | Suben | 451/388 |
| 3,144,737 | A | * | 8/1964 | Faas | 451/538 |
| 3,404,488 | A | * | 10/1968 | Cox et al. | 451/42 |
| 3,417,454 | A | * | 12/1968 | Beasley | 29/468 |
| 3,865,178 | A | * | 2/1975 | Legendre | 164/334 |

(Continued)

FOREIGN PATENT DOCUMENTS

| | | |
|---|---|---|
| DE | 39 34 180 | 4/1990 |
| DE | 10 31 0561 | 10/2004 |

(Continued)

*Primary Examiner* — George Nguyen
(74) *Attorney, Agent, or Firm* — Cozen O'Connor

(57) ABSTRACT

Method for mounting an optical lens (10) to be polished on a spindle (20) of a polishing device, the optical lens (10) comprising a first and a second main surface (101, 102), the method comprising: an optical lens (10) providing step (S1), in which an optical lens (10) whose first main surface (101) is to be polished is provided, a mounting step (S2), in which the optical lens (10) is mounted on the spindle (20), wherein, the mounting step (S2) further comprises a support device positioning step (S3), in which a support device (30) is positioned between the spindle (20) and the second surface (102) of the optical lens (10) so as to be rotated by the spindle (20) and to have a contact surface (31) partly in contact with the second main surface (102) of the optical lens (10) that partly extends beyond the second main surface (102) of the optical lens (10).

20 Claims, 2 Drawing Sheets

(56) References Cited

U.S. PATENT DOCUMENTS

| | | | | |
|---|---|---|---|---|
| 3,996,701 | A * | 12/1976 | Ramirez et al. | 451/390 |
| 5,763,075 | A * | 6/1998 | Benjamin et al. | 428/349 |
| 6,107,366 | A * | 8/2000 | Benjamin et al. | 523/168 |
| 6,733,369 | B1 | 5/2004 | Stacklies et al. | |
| 6,855,042 | B1 * | 2/2005 | Werner et al. | 451/390 |
| 2002/0031993 | A1 | 3/2002 | Jung et al. | |
| 2003/0190872 | A1 * | 10/2003 | Arai et al. | 451/42 |
| 2006/0089088 | A1 | 4/2006 | Feucht et al. | |
| 2007/0105490 | A1 * | 5/2007 | Achy et al. | 451/390 |
| 2008/0299881 | A1 * | 12/2008 | Herbin et al. | 451/390 |
| 2009/0109397 | A1 | 4/2009 | Arrigotti et al. | |
| 2010/0297919 | A1 * | 11/2010 | Freson et al. | 451/42 |

FOREIGN PATENT DOCUMENTS

| | | |
|---|---|---|
| EP | 1 649 977 | 4/2006 |
| JP | 11-198014 | 7/1999 |
| JP | 2001-054862 | 2/2001 |
| JP | 2002-326148 | 11/2002 |
| JP | 2007-000989 | 1/2007 |
| JP | 2008-142840 | 6/2008 |
| JP | 2009-034784 | 2/2009 |
| JP | 2009-107089 | 5/2009 |
| WO | WO 01/54861 | 8/2001 |

* cited by examiner

METHOD FOR MOUNTING AN OPTICAL LENS TO BE POLISHED

RELATED APPLICATIONS

This is a U.S. National Phase Application under 35 USC 371 of International Application PCT/EP2010/070598 filed on Dec. 22, 2010.

This application claims the priority of European application no. 09306328.7 filed Dec. 24, 2009, the entire content of which is hereby incorporated by reference.

BACKGROUND OF THE INVENTION

This invention relates to a method for polishing an optical lens.

The process of preparing optical or ophthalmic lenses begins with an unfinished or semi-finished glass or plastic lens blank. Typically a semi-finished lens blank has a finished polished front surface and an unfinished back surface. By grinding away material from the back and/or front surface of the lens blank the required corrective prescription is generated.

Thereafter the surface having had the corrective prescription imparted thereto is polished and the peripheral edge of the thus processed lens blank is provided with a final desired contour thereby establishing a finished optical or ophthalmic lens.

The grinding process may create surface roughness on the surface of the lens, which tends to undesirably scatter light passing to or from the lens. To reduce this surface roughness, the lens is polished to obtain a smoother surface.

The lens blank can be either a plastic or a glass lens blank. Blanks used for eyeglasses typically are made by injection molding or casting a thermosetting polymer such as di ethylene glycol bis(allyl carbonate) (CR-39) or polycarbonate.

Most automated cutting machines have a cutter that is held stationary while rotating the lens and moving it along two axes with respect to the cutter. If the lens requires a curvature in addition to simple spherical and/or cylindrical cuts, the lens can be ground while tilted to produce an offset optical center (i.e. an induced prism).

After the lens is cut, it is polished. Polishing method may include polishing the surface of the optical lens with the aid of a polishing tool for example a polishing pad.

Some optical lenses after the grinding step may have so called sharp edges. That is edges that may damage the polishing tool during the polishing step.

A problem linked to the sharp edges is that during the polishing step the polishing tools are prematurely damaged for example the polishing pad is worn or the foam is torn off by cutting.

In the case of glass with sharp edges the lifetime of the polishing tool may be divided by 5 or 10 compared to the case of glass with no sharp edges.

SUMMARY OF THE INVENTION

One object of the present invention is to provide a polishing method that allows polishing a sharp edge optical lens and reduces the damage done to the polishing tool by such sharp edge of such optical lens.

This object is obtained according to one aspect of the invention by a method for mounting an optical lens to be polished on a spindle of a polishing device, the optical lens comprising a first and a second main surface, the method comprising:

an optical lens providing step, in which an optical lens whose first main surface is to be polished is provided, a mounting step, in which the optical lens is mounted on a spindle, wherein, the mounting step further comprises a support device positioning step, in which a support device is positioned between the spindle and the second surface of the optical lens so as to be rotated by the spindle and to have a contact surface partly in contact with the second main surface of the optical lens that partly extends beyond the second main surface of the optical lens so as to extend the second main surface of the optical lens.

Advantageously, the use of a support device extending beyond the second main surface of the optical lens allows reducing the wear of the polishing tool against the sharp edges of the optical lens.

Indeed, the use of a support device extending beyond the second main surface of the optical lens extends the second surface of the optical lens and therefore suppresses the sharp edges of the optical lens.

According to further embodiments which can be considered alone or in combination:

- the support device presents a modulus of elasticity greater or equal to 0.1 MPa and smaller or equal to 1 MPa,
- the contact surface of the support device is at least partly covered with a membrane having a Shore-hardness greater or equal to 40 D and smaller or equal to 100 D,
- the contact surface of the support device is at least partly covered with a membrane having a tensile strength greater or equal to 10 MPa and smaller or equal to 20 MPa,
- the membrane is made of an elastomer,
- the membrane is made of a fluoro and/or nitrile based elastomer,
- the contact surface is totally covered with a membrane,
- the support device is made of foam,
- the support device is made of polyurethane foam,
- the membrane presents a resistance to traction of at least 0.5 $N/mm^2$,
- the membrane presents a tear resistance of at least 2 N/mm,
- at least 10% of the contact surface of the support device extends beyond the second main surface of the optical lens,
- the optical lens and the support device have circular or elliptic shapes and the ratio between the diameters or the major axis of the support device and of the optical lens is greater or equal to 1.1,
- the support device has a thickness of at least 0.5 mm,
- the support device and the spindle are interlocked, and
- the support device is screwed or pasted to the spindle.

The invention further relates to a method for polishing an optical lens mounted to a spindle using a method according to the invention is polished using a polishing tool.

BRIEF DESCRIPTION OF THE DRAWINGS

Non limited embodiments of the invention will now be described with reference to the accompanying drawing wherein.

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

The wording "upper" or "on" and "bottom" or "under" indicates positions relative to the optical lens when it is arranged so as the edge of the optical lens to be machined is substantially situated in a horizontal plane.

Said position is purely conventional and the optical lens component can be polished in a non horizontal position.

DETAILED DESCRIPTION

Figure 1:
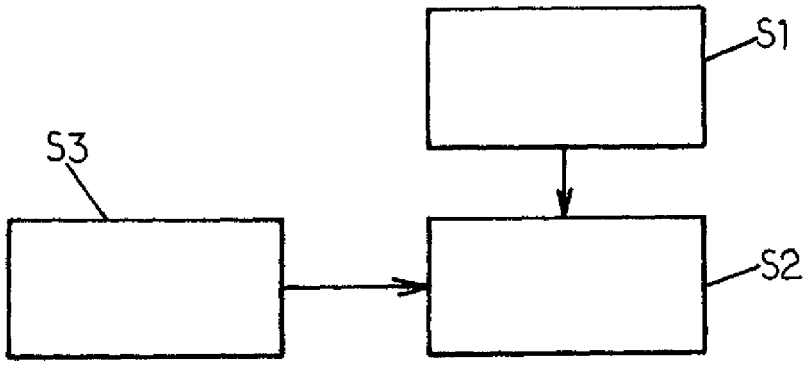
FIG. 1 is a flowchart of the steps comprised in a method of mounting an optical lens to be polished according to an embodiment of the invention.

As represented on FIG. 1, the method for mounting on a spindle an optical lens to be polished according to the invention may comprise:

an optical lens providing step S1, a mounting step S2, and during the mounting step S2, the method may further comprise a support device positioning step S3.

During the optical lens providing step S1, an optical lens is provided. As represented on FIG. 2, the optical lens 10 comprises a first 101 and a second 102 main face surface. The first main surface 101 of the optical lens 10 is to be polished.

Figure 2:
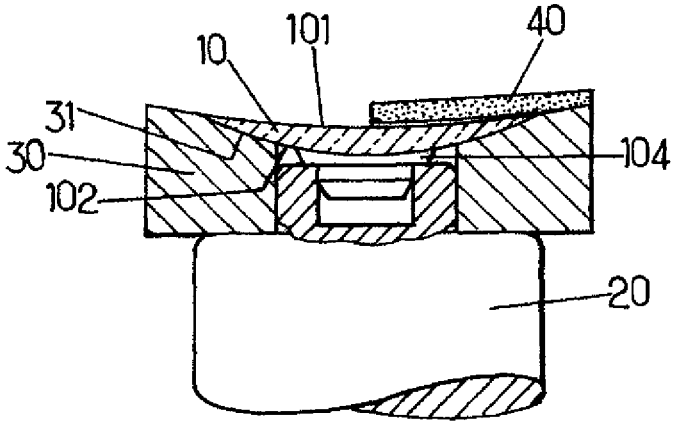
FIG. 2 is a cross sectional view of an optical lens mounted on a spindle using a support device used in a method according to a first embodiment of the invention.

According to an embodiment of the invention represented on FIG. 2, the optical lens is provided with a holding unit 104 secured to the second main surface 102 of the optical lens 10.

According to an embodiment of the invention, the optical lens 10 may be an ophthalmic lens. The first main surface 101 of the optical/ophthalmic lens 10 may be the rear face of the optical/ophthalmic lens and the second main surface 102 of the optical/ophthalmic lens 10 may be the front face of the optical/ophthalmic lens.

The holding unit may be secured to the second main surface 102 of the optical lens 10 by any means known from the skilled person. For example, the material that may be used to secure the optical lens 10 to the holding unit 104 may include glues, pitch, low temperature fusible metal alloys or thermoplastic materials such as disclosed in U.S. Pat. No. 6,036,313.

As represented on FIG. 2, during the mounting step S2, the optical lens 10 is mounted on the spindle 20 so as to be polished.

According to an embodiment of the invention, the optical lens 10 is mounted to the spindle 20 using the holding unit 104.

During the support device positioning step S3, a support device 30 is positioned between the spindle 20 and the second surface 102 of the optical lens 10.

The support device 30 is positioned so as to be rotated by the spindle 20, for example the support device and the spindle are interlocked. According to an embodiment of the invention the support device 30 may be screwed or pasted to the spindle 20.

The support device 30 has a contact surface 31. During the support device positioning step S3, the support device 30 is positioned so as to have the contact surface 31 of the support device 30 partly in contact with the second main surface 102 of the optical lens and to have the contact surface 31 of the support device that partly extends beyond the second main surface 102 of the optical lens 10.

When the optical lens to be polished is mounted according to the invention the second main surface 102 of the optical lens 10 is extended thanks to the support device 30. For example, according to an embodiment of the invention, at least 10% of the contact surface 31 extends beyond the second main surface 102 of the optical lens 10 when the optical lens 10 is mounted according to the method of the invention.

Advantageously, the extension of the second main surface 102 of the optical lens avoids that the optical lens has a sharp edge.

Thus, when polishing an optical lens 10 using a method according to the invention, the polishing tool does not wear out as fast as when the optical lens is mounted using prior art methods. The inventors have observed that the life time of the polishing tool when polishing an optical lens mounted according to the invention can be multiplied by 5 or 10.

According to an embodiment of the invention, the optical lens and the support device have circular or elliptic shapes and the ratio between the diameters or the major axis of the support device and of the optical lens is greater or equal to 1.1.

According to an embodiment of the invention, the support device presents a modulus of elasticity greater or equal to 0.1 MPa and smaller of equal to 1 MPa.

Advantageously, using a support device having a modulus of elasticity greater or equal to 0.1 MPa allows that the support device 30 offers enough resistance to the polishing tool so as to effectively extend beyond the second surface 102 of the optical lens 10 when the polishing tool 40 comes in contact with the first surface 101 of the optical lens 10 and the contact surface 31 of the support device 30.

Advantageously, using a support device having a modulus of elasticity smaller or equal to 1 MPa allows that the back moving force applied to the optical lens when blocked to be polished is not to important so as to avoid that the optical lens be deformed by the back moving force during the polishing process. This allows preserving the optical properties of the optical lens during the polishing process.

According to an embodiment of the invention, the support device has a thickness of at least 0.5 mm, for example of at least 1 mm. Advantageously, having a thickness greater or equal to 0.5 mm increases the life time of the support device.

According to an embodiment of the invention, the support device may be made of a foam, for example a polyurethane foam.

Advantageously, a support device 30 made of foam allows adjusting the modulus of elasticity of the support device 30 so as to have a support device having a modulus of elasticity that is large enough so that the support device does not bend under the force of the polishing tool and small enough so that the back moving force applied by the support device to the optical lens when mounted does not deform the optical lens to be polished.

Figure 3:
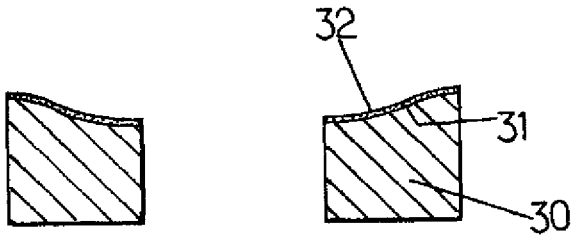
FIG. 3 is a cross sectional view of an support device according to a second embodiment of the invention.

According to an embodiment of the invention illustrated by FIG. 3, the contact surface 31 of the support device 30 is at least partly covered with a membrane 32 having a Shore-hardness greater or equal to 40 D and smaller or equal to 100 D and/or a tensile strength greater or equal to 10 MPa and smaller or equal to 20 MPa.

The inventors have observed that covering at least partly the contact surface 31 of the support device 30 with a membrane 32 reduces the friction between the polishing tool 40 and the contact surface 31 of the support device 30. Advantageously, having a membrane with a Shore-hardness greater or equal to 40 D and smaller or equal to 100 D and/or a tensile strength greater or equal to 10 MPa and smaller or equal to 20 MPa, increases the life time of the polishing tool 40 and of the support device 30.

According to an embodiment of the invention, the membrane 32 presents a resistance to traction of at least 0.5 $N/mm^2$. The inventors have observed that a membrane having a resistance to traction lower than 0.5 $N/mm^2$ reduces the life time of the membrane and increase the cost of the polishing process.

According to an embodiment of the invention, the membrane 32 presents a tear resistance of at least 2 N/mm. The tear resistance of the membrane is measured according to the DIN 53515 standard. The inventors have observed that a membrane having a tear resistance lower than 2 N/mm reduces the life time of the membrane and increase the cost of the polishing process.

According to an embodiment of the invention, the membrane 32 is made of an elastomer, for example a fluoro and/or nitrile based elastomer, for example Viton® elastomer sold by Dupont.

The support device used in the method according to the invention may have various shapes.

Figure 4:
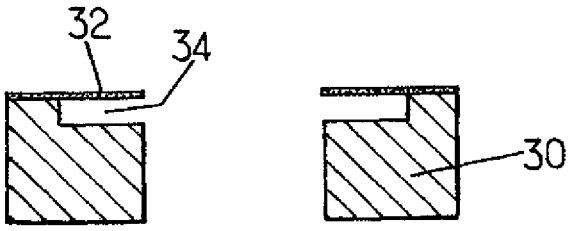
FIG. 4 is a cross sectional view of an support device according to a third embodiment of the invention.

According to an embodiment of the invention represented on FIG. 4, the central upper part of the support device 30 may comprise a recess 34. The contact surface 31 of the support device 30 may be covered with a membrane 32 that extends at least partly over the recess 34. Advantageously, a support device comprising a recess 34 in its central upper part may be used for a large type of optical lenses to be polished. In particular, the support device may be used for a large range of optical lens curvature.

According to an embodiment of the invention, the support device may comprise a rigid base and a foam part. The rigid base is arranged to be mounted on the lathe support and has a modulus of elasticity greater than 1 MPa. The foam part has a modulus of elasticity between 0.1 MPa and 1 MPa and a contact surface arranged to be partly in contact with the second main surface 102 of the optical lens and to partly extend beyond the second main surface 102 of the optical lens 10.

According to different embodiments of the invention the support device may comprise a bellows mechanism, or be in the shape of plastic leaf spring or of a drumhead stretched over a frame.

The invention has been described above with the aid of embodiments without limitation of the general inventive concept. In particular the present invention provides a method for mounting all kinds of optical lenses, particularly ophthalmic lenses, e.g. single vision (spherical, torical), bi-focal, progressive, aspherical lenses (etc.), semi-finished optical lenses and/or blanks, blanks for polishing optical lenses.

The invention claimed is:

1. A method for mounting an optical lens to be polished on a spindle of a polishing device, the optical lens comprising a first and a second main surface, the method comprising:

an optical lens providing step, in which an optical lens whose first main surface is to be polished is provided; and a mounting step, in which the optical lens is mounted on the spindle, wherein the mounting step further comprises a support device positioning step, in which a support device is positioned between the spindle and the second surface of the optical lens so as to be rotated by the spindle and to have a contact surface partly in contact with the second main surface of the optical lens that partly extends beyond the second main surface of the optical lens so as to extend the second main surface of the optical lens; and wherein the contact surface of the support device is at least partly covered with a membrane having a Shore-hardness greater or equal to 40 D and smaller or equal to 100 D.

2. The method according to claim 1, wherein the support device presents a modulus of elasticity greater or equal to 0.1 MPa and smaller or equal to 1 MPa.

3. The method according to claim 1, wherein the contact surface of the support device is at least partly covered with a membrane having a tensile strength greater or equal to 10 MPa and smaller or equal to 20 MPa.

4. The method according to claim 1, wherein the membrane is made of an elastomer.

5. The method according to claim 1, wherein the contact surface is totally covered with a membrane.

6. The method according to claim 1, wherein the membrane presents a resistance to traction of at least 0.5 $N/mm^2$.

7. The method according to claim 1, wherein the membrane presents a tear resistance of at least 2 N/mm.

8. The method according to claim 1, wherein the support device is made of foam.

9. The method according to claim 1, wherein at least 10% of the contact surface of the support device extends beyond the second main surface of the optical lens.

10. The method according to claim 1, wherein the optical lens and the support device have circular or elliptic shapes and where the ratio between the diameters or the major axis of the support device and of the optical lens is greater or equal to 1.1.

11. The method according to claim 1, wherein the support device has a thickness of at least 0.5 mm.

12. The method according to claim 1, wherein the support device and the spindle are interlocked.

13. A method for polishing an optical lens, wherein the optical lens is mounted to a spindle of a polishing tool, the optical lens comprising a first and a second main surface, the method comprising:

an optical lens providing step, in which an optical lens whose first main surface is to be polished is provided, a mounting step, in which the optical lens is mounted on the spindle, wherein the mounting step further comprises a support device positioning step, in which a support device is positioned between the spindle and the second surface of the optical lens so as to be rotated by the spindle and to have a contact surface partly in contact with the second main surface of the optical lens that partly extends beyond the second main surface of the optical lens so as to extend the second main surface of the optical lens; and wherein the contact surface of the support device is at least partly covered with a membrane having a Shore-hardness greater or equal to 40 D and smaller or equal to 100 D.

14. A method for mounting an optical lens to be polished on a spindle of a polishing device, the optical lens comprising a first and a second main surface, the method comprising:

an optical lens providing step, in which an optical lens whose first main surface is to be polished is provided; and a mounting step, in which the optical lens is mounted on the spindle, wherein the mounting step further comprises a support device positioning step, in which a support device is positioned between the spindle and the second surface of the optical lens so as to be rotated by the spindle and to have a contact surface partly in contact with the second main surface of the optical lens that partly extends beyond the second main surface of the optical lens so as to extend the second main surface of the optical lens; and wherein the contact surface of the support device is at least partly covered with a membrane having a tensile strength greater or equal to 10 MPa and smaller or equal to 20 MPa.

15. The method according to claim 14, wherein the support device presents a modulus of elasticity greater or equal to 0.1 MPa and smaller or equal to 1 MPa.

16. The method according to claim 14, wherein the membrane is made of an elastomer.

17. The method according to claim 14, wherein the contact surface is totally covered with a membrane.

18. The method according to claim 14, wherein the membrane presents a resistance to traction of at least 0.5 $N/mm^2$.

19. The method according to claim 14, wherein the membrane presents a tear resistance of at least 2 N/mm.

20. A method for polishing an optical lens, wherein the optical lens is mounted to a spindle of a polishing tool, the optical lens comprising a first and a second main surface, the method comprising:

an optical lens providing step, in which an optical lens whose first main surface is to be polished is provided, a mounting step, in which the optical lens is mounted on the spindle, wherein the mounting step further comprises a support device positioning step, in which a support device is positioned between the spindle and the second surface of the optical lens so as to be rotated by the spindle and to have a contact surface partly in contact with the second main surface of the optical lens that partly extends beyond the second main surface of the optical lens so as to extend the second main surface of the optical lens; and wherein the contact surface of the support device is at least partly covered with a membrane having a tensile strength greater or equal to 10 MPa and smaller or equal to 20 MPa.

* * * * *